US011848508B2

(12) United States Patent
Su

(10) Patent No.: US 11,848,508 B2
(45) Date of Patent: Dec. 19, 2023

(54) FLEXIBLE CONNECTOR AND MANUFACTURING METHOD

(71) Applicant: GUANGZHOU FANGBANG ELECTRONICS CO., LTD., Guangzhou (CN)

(72) Inventor: Zhi Su, Guangzhou (CN)

(73) Assignee: GUANGZHOU FANGBANG ELECTRONICS CO., LTD., Guangzhou (CN)

( * ) Notice: Subject to any disclaimer, the term of this patent is extended or adjusted under 35 U.S.C. 154(b) by 333 days.

(21) Appl. No.: 17/285,177

(22) PCT Filed: Jul. 15, 2019

(86) PCT No.: PCT/CN2019/095936
§ 371 (c)(1),
(2) Date: Apr. 14, 2021

(87) PCT Pub. No.: WO2020/093729
PCT Pub. Date: May 14, 2020

(65) Prior Publication Data

US 2021/0384654 A1 Dec. 9, 2021

(30) Foreign Application Priority Data

Nov. 9, 2018 (CN) ..... 201811329995.0

(51) Int. Cl.
*H01R 12/52* (2011.01)
*H01R 13/03* (2006.01)
*H01R 43/16* (2006.01)

(52) U.S. Cl.
CPC ..... *H01R 12/52* (2013.01); *H01R 13/03* (2013.01); *H01R 43/16* (2013.01)

(58) Field of Classification Search
CPC ..... H01R 12/52; H01R 13/03; H01R 43/16
(Continued)

(56) References Cited

U.S. PATENT DOCUMENTS 6,889,433 B1 * 5/2005 Enomoto ..... H05K 3/4069 29/846
8,399,779 B2 * 3/2013 Ogawa ..... H01L 23/49822 174/262
(Continued)

FOREIGN PATENT DOCUMENTS

CN 201725896 U 1/2011
CN 103404239 A 11/2013
(Continued)

OTHER PUBLICATIONS

International Search Report for corresponding application PCT/CN2019/095935 filed Jul. 15, 2019, Report dated Oct. 16, 2019.
(Continued)

*Primary Examiner* — Peter G Leigh
(74) *Attorney, Agent, or Firm* — CANTOR COLBURN LLP

(57) ABSTRACT

A flexible connector, comprising an insulator (10), multiple first conductors (11) are disposed on one side surface of the insulator (10), and multiple second conductors (12) are disposed on the other side surface of the insulator (10), the insulator (10) is further provided with a conductive medium (13) connecting the first conductors (11) and the second conductors (12), and protrusion portions (14) are disposed on the surfaces of the first conductors (11) and the second conductors (12).

30 Claims, 5 Drawing Sheets

(58) Field of Classification Search
USPC ..... 439/626
See application file for complete search history.

(56) References Cited

U.S. PATENT DOCUMENTS

| | | | | |
|---|---|---|---|---|
| 8,797,757 | B2 * | 8/2014 | Kaneko | H05K 3/4682 361/767 |
| 8,952,507 | B2 * | 2/2015 | Shimabe | H01L 24/80 257/668 |
| 8,987,901 | B2 * | 3/2015 | Sasaoka | H01L 23/49861 257/737 |
| 9,161,461 | B2 * | 10/2015 | Hurwitz | H05K 3/4697 |
| 9,204,541 | B2 * | 12/2015 | Chisaka | H05K 1/115 |
| 9,236,334 | B2 * | 1/2016 | Kaneko | H05K 3/244 |
| 9,269,593 | B2 * | 2/2016 | Hurwitz | H01L 23/49827 |
| 9,334,576 | B2 * | 5/2016 | Miyazawa | C25D 7/123 |
| 9,433,109 | B2 * | 8/2016 | Kaneko | H05K 3/4682 |
| 2011/0209904 | A1 * | 9/2011 | Ishida | H05K 1/0222 174/257 |
| 2015/0382461 | A1 | 12/2015 | Ha | |

FOREIGN PATENT DOCUMENTS

| | | | | | |
|---|---|---|---|---|---|
| CN | 103857189 | A | | 6/2014 | |
| CN | 105101761 | A | | 11/2015 | |
| CN | 105778815 | A | | 7/2016 | |
| CN | 206271924 | U | | 6/2017 | |
| CN | 209232989 | U | | 8/2019 | |
| CN | 209232990 | U | | 8/2019 | |
| CN | 209232991 | U | | 8/2019 | |
| CN | 209233016 | U | | 8/2019 | |
| EP | 1220588 | A1 | * | 7/2002 | H05K 3/4069 |
| IN | 201656033 | U | | 11/2010 | |
| JP | 2001024298 | A | * | 1/2001 | H05K 3/4069 |
| JP | 2001338951 | A | * | 12/2001 | |
| JP | 2009004593 | A | * | 1/2009 | H01L 24/10 |
| JP | 2009130095 | A | * | 6/2009 | H01L 23/49861 |
| JP | 2009252942 | A | * | 10/2009 | |
| JP | 2013102248 | A | * | 5/2013 | H01L 2224/32225 |
| KR | 20190042654 | | * | 4/2019 | C09J 7/10 |
| WO | 2016158775 | A1 | | 10/2016 | |

OTHER PUBLICATIONS

International Search Report for corresponding application PCT/CN2019/095936 filed Jul. 15, 2019, dated Oct. 16, 2019.

* cited by examiner

FLEXIBLE CONNECTOR AND MANUFACTURING METHOD

CROSS REFERENCE TO RELATED APPLICATIONS

This application is the U.S. national stage of International Patent Application Number PCT/CN2019/095936, filed on Jul. 15, 2019, which claims priority to Chinese Patent Application Number 201811329995.0 filed on Nov. 9, 2018, the contents of both of said applications are hereby incorporated by reference.

TECHNICAL FIELD

The disclosure relates to the technical field of electrical connectors, and in particular to a flexible connector and a manufacturing method.

BACKGROUND

In the electronic industry, connection modes such as welding (BGA) and conductive adhesive connection are widely used among electronic components such as chips and circuit boards. The welding has the advantages of reliable connection, but also is incapable of being repeatedly disassembled and assembled, and if operation errors occur in the welding process or poor conduction occurs after welding, the soldered electronic component can only consume more resources to be reworked or directly scrapped, so that material waste and cost are caused. The conductive adhesive connection is easier to implement compared with the welding and is convenient for rework and maintenance, but due to the problems of the conductive adhesive and the influence of external factors such as climate, aging and stress strain, the conductive performance of the conductive adhesive is not stable enough, so that the problems of circuit interruption or signal distortion easily occur between electronic elements connected by a conductive adhesive.

In order to avoid the defects of the above connection mode, a new connection mode, namely connector connection, is adopted between the existing electronic components, the connector is mainly composed of an insulator and conductors disposed on two sides of the insulator, a conductive medium connecting the conductors on the two sides being disposed on the insulator. During use, the connector is clamped between two circuit boards and fastened, and the conductors are attached to pads on the circuit boards so as to realize circuit conduction. In order to ensure reliable electrical connection between the conductors and the pad, copper-plated elastic arms are usually disposed on the conductors, but the arrangement of the elastic arms also brings some new problems:

Firstly, the manufacturing difficulty of the connector is improved, multiple manufacturing processes such as welding of elastic arms and copper plating are added, and meanwhile the manufacturing cost of the connectors is increased.

Secondly, after the connector is disassembled and assembled for many times, the elastic arm is prone to fatigue damage and even is directly broken, and the service life of the connector is shortened.

Thirdly, copper plated on the surface of the elastic arm is easy to fall off along with deformation of the elastic arm, and the conductive performance of the connector is influenced.

Fourthly, the bouncing amplitude of each elastic arm on the connector cannot be unified, the situation that a part of the elastic arms are in contact with the circuit board while a part of the elastic arms are not in contact with the circuit board easily occurs, and it is difficult to ensure the conductivity of the connector.

Therefore, it is necessary to design a connector which is excellent in conductivity and durable, and facilitates the assembly and disassembly of electronic components.

SUMMARY

In order to solve the above technical problem that the electrical connection performance of the existing connector is unreliable, the disclosure provides a flexible connector and a manufacturing method. The flexible connector is used for mounting and connecting a circuit board, and has the advantages of being repeatedly disassembled and assembled, good in conductivity and the like. Moreover, the manufacturing method thereof is simple and easy to implement.

Based on this, the disclosure provides a flexible connector, which comprises an insulator, a plurality of first conductors being disposed on one side surface of the insulator, a plurality of second conductors being disposed on the other side surface of the insulator, the insulator being further provided with a conductive medium connecting the first conductors and the second conductors, and a protrusion portion being disposed on the surfaces of the first conductors or/and the second conductors.

As a solution, the protrusion portion has a regular solid geometry or irregular solid geometry.

As a solution, the protrusion portion has a pointed corner shape, an inverted cone shape, a granular shape, a dendritic shape, a columnar shape, or a block shape.

As a solution, the protrusion portion has a height of 1 μm to 30 μm.

As a solution, the surfaces of the first conductor or/and the second conductor are provided with two or more of the protrusion portions, each one of the protrusion portions having the same or different shapes, each one of the protrusion portions having the same or different sizes, as well as two or more of the protrusion portions being continuously or discontinuously distributed on the surfaces of the first conductor or/and the second conductor.

As a solution, the surfaces of the first conductor or/and the second conductor are rough.

As a solution, the surfaces of the first conductor or/and the second conductor are flat.

As a solution, the protrusion portion is made of one or a combination of a group consist of copper, nickel, tin, lead, chromium, molybdenum, zinc, gold, and silver.

As a solution, an adhesive film layer is disposed on at least one side surface of the insulator or/and the protrusion portion, and the protrusion portion is hidden in the adhesive film layer or penetrates through the adhesive film layer and is exposed.

As a solution, the insulator is provided with a connection hole connecting the first conductor and the second conductor, and the conductive medium is disposed in the connection hole.

As a solution, the conductive medium fills the whole of connection hole, or the conductive medium is attached to a hole wall of the connection hole and forms a conductive hole.

As a solution, the number of the first conductors is two or more, the first conductors are independent of each other, and the number of the second conductors is two or more, the second conductors are independent of each other.

As a solution, the number of the second conductors is equal to the number of the first conductors, and the first conductors are respectively connected to the second conductors in a one-to-one correspondence manner through the conductive medium in the different connection holes.

As a solution, the number of the first conductors is more than the number of the second conductors, at least two of the first conductors are respectively connected to the same second conductor through the conductive medium in the different connection holes, and the other first conductors are respectively connected to the other second conductors in a one-to-one correspondence manner through the conductive medium in the different connection holes.

As a solution, the number of the first conductors is less than the number of the second conductors, at least two of the second conductors are respectively connected to the same first conductor through the conductive medium in the different connection holes, and the other second conductors are respectively connected to the other first conductors in a one-to-one correspondence manner through the conductive medium in the different connection holes.

As a solution, at least two of the first conductors are respectively connected to the same second conductor through the conductive medium in different connection holes, and at least two of the second conductors are respectively connected to the same first conductor through the conductive medium in the different connection holes.

As a solution, at least two of the first conductors in a part of the first conductors are respectively connected to the same second conductor in a part of the second conductors through the conductive medium in the different connection holes, at least two of the second conductors in another part of the second conductors are respectively connected to the same first conductor in another part of the first conductors through the conductive medium in the different connection holes, and the other first conductors are respectively connected to the other second conductors in a one-to-one correspondence manner through the conductive medium in the different connection holes.

As a solution, two or more of the connection holes are provided between the first conductor and the second conductor connected therewith.

As a solution, the insulator is made of one or a combination of a group consist of polyimide, thermoplastic polyimide, modified epoxy resin, modified acrylic resin, polyethylene terephthalate, polybutylene terephthalate, polyethylene, polyethylene naphthalate, polystyrene, polyvinyl chloride, polysulfone, polyphenylene sulfide, polyetheretherketone, polyphenylene oxide, polytetrafluoroethylene, liquid crystal polymers, and polyparabanic acid.

Further, the insulator is a flexible insulator, the first conductors and the second conductors are disposed on two opposite side surfaces of the insulator, and the protrusion portion is a plated protrusion portion.

Further, the protrusion portion is hidden in the adhesive film layer, the thickness of the adhesive film layer being smaller than an average value of the height of the protrusion portion.

The disclosure also provides a manufacturing method of a flexible connector, which includes the following steps.

A flexible copper-clad plate is manufactured, the flexible copper-clad plate including an insulator and copper foils disposed on two opposite surfaces of the insulator.

A connection hole is formed on the flexible copper-clad plate.

A conductive medium is formed in the connection hole to make the connection hole conductive, while forming a protrusion portion on the surface of the copper foil on at least one side of the flexible copper-clad plate.

Two sides of the flexible copper-clad plate are etched respectively to form a first conductor and a second conductor.

Further, in the manufacturing method of a flexible connector, the connection hole connecting the copper foils on two sides is formed in the flexible copper-clad plate by means of mechanical drilling, laser drilling or punching.

Further, in the manufacturing method of a flexible connector, the operation that the conductive medium is formed in the connection hole while forming the protrusion portion on the surface of the copper foil on at least one side of the flexible copper-clad plate specifically includes that:

a layer of thin the conductive medium is deposited on a hole wall of the connection hole through a chemical reaction, the thickness of the conductive medium on the hole wall is increased and a conductive hole is formed by one or more of electroplating, chemical plating, physical vapor deposition, and chemical vapor deposition, while forming the protrusion portion on the surface of the copper foil on at least one side of the flexible copper-clad plate;

or a layer of thin layer of the conductive medium is deposited on a hole wall of the connection hole through a chemical reaction, the connection hole is filled with the conductive medium by one or more of electroplating, chemical plating, physical vapor deposition, and chemical vapor deposition, while forming the protrusion portion on the surface of the copper foil on at least one side of the flexible copper-clad plate.

Further, in the manufacturing method of a flexible connector, after two sides of the flexible copper-clad plate are etched respectively to form the first conductor and the second conductor, the method further includes that: an adhesive film layer is formed on at least one side surface of the flexible copper-clad plate, specifically including that:

the adhesive film layer is coated on a release film, and then the adhesive film layer is laminated and transferred to at least one side surface of the flexible copper-clad plate through the release film;

or the adhesive film layer is directly coated on at least one side surface of the flexible copper-clad plate.

The disclosure also provides a second manufacturing method of a flexible connector, which includes the following steps.

A flexible copper-clad plate is manufactured, the flexible copper-clad plate including an insulator and copper foils disposed on two opposite surfaces of the insulator.

A connection hole is formed on the flexible copper-clad plate.

A conductive medium is formed in the connection hole to make the connection hole conductive.

Copper foils are etched on two sides of the flexible copper-clad plate respectively to form multiple first conductors and multiple second conductors.

Protrusion portions are formed on the surfaces of the first conductors or/and the second conductors.

Further, in the manufacturing method of a flexible connector, the connection hole connecting the copper foils on two sides is formed in the flexible copper-clad plate by means of mechanical drilling, laser drilling or punching.

Further, in the manufacturing method of a flexible connector, the operation that the conductive medium is formed in the connection hole specifically includes that:

a layer of thin the conductive medium is deposited on a hole wall of the connection hole through a chemical reaction, the thickness of the conductive medium on the hole wall is increased and a conductive hole is formed by one or more of electroplating, chemical plating, physical vapor deposition, and chemical vapor deposition;

or a layer of thin the conductive medium is deposited on a hole wall of the connection hole through a chemical reaction, the connection hole is filled with the conductive medium by one or more of electroplating, chemical plating, physical vapor deposition, and chemical vapor deposition.

Further, in the manufacturing method of a flexible connector, the protrusion portions are formed on the surfaces of the first conductors or/and the second conductors by one or more of electroplating, chemical plating, physical vapor deposition, and chemical vapor deposition.

Further, in the manufacturing method of a flexible connector, after the protrusion portions are formed on the surfaces of the first conductors or/and the second conductors, the method further includes that: an adhesive film layer is formed on at least one side surface of the flexible copper-clad plate, specifically including that:

the adhesive film layer is coated on a release film, and then the adhesive film layer is laminated and transferred to at least one side surface of the flexible copper-clad plate through the release film;

or the adhesive film layer is directly coated on at least one side surface of the flexible copper-clad plate.

The disclosure also provides a third manufacturing method of a flexible connector, which includes the following steps.

A flexible copper-clad plate is manufactured, the flexible copper-clad plate including an insulator and copper foils disposed on two opposite surfaces of the insulator.

A protrusion portion is formed on the surface of the copper foil on at least one side of the flexible copper-clad plate.

A connection hole is formed on the flexible copper-clad plate.

A conductive medium is formed in the connection hole to make the connection hole conductive.

Two sides of the flexible copper-clad plate are etched respectively to form a first conductor and a second conductor.

Further, in the manufacturing method of a flexible connector, the protrusion portion is formed on the surface of the copper foil on at least one side of the flexible copper-clad plate by one or more of electroplating, chemical plating, physical vapor deposition, and chemical vapor deposition.

Further, in the manufacturing method of a flexible connector, the connection hole connecting the copper foils on two sides is formed in the flexible copper-clad plate by means of mechanical drilling, laser drilling or punching.

Further, in the manufacturing method of a flexible connector, the operation that the conductive medium is formed in the connection hole specifically includes that:

a layer of thin the conductive medium is deposited on a hole wall of the connection hole through a chemical reaction, the thickness of the conductive medium on the hole wall is increased and a conductive hole is formed by one or more of electroplating, chemical plating, physical vapor deposition, and chemical vapor deposition;

or a layer of thin the conductive medium is deposited on a hole wall of the connection hole through a chemical reaction, the connection hole is filled with the conductive medium by one or more of electroplating, chemical plating, physical vapor deposition, and chemical vapor deposition.

Further, in the manufacturing method of a flexible connector, after the protrusion portions and the copper foils are etched on two sides of the flexible copper-clad plate respectively to form multiple first conductors with protrusion portions on the surfaces and multiple second conductors with protrusion portions on the surfaces, the method further includes that: an adhesive film layer is formed on at least one side surface of the flexible copper-clad plate, specifically including that:

the adhesive film layer is coated on a release film, and then the adhesive film layer is laminated and transferred to at least one side surface of the flexible copper-clad plate through the release film;

or the adhesive film layer is directly coated on at least one side surface of the flexible copper-clad plate.

The implementation of the embodiments of the disclosure has the following beneficial effects.

The flexible connector provided by the embodiments of the disclosure includes an insulator. Multiple first conductors are disposed on one side surface of the insulator, and multiple second conductors are disposed on the other side surface of the insulator. The insulator is further provided with a conductive medium connecting the first conductors and the second conductors, and protrusion portions are disposed on the surfaces of the first conductors or/and the second conductors. Based on the above structure, on one hand, by clamping the flexible connector provided by the embodiments of the disclosure between two circuit boards, and performing the first conductor and the second conductor adhere to pads on the two circuit boards respectively, the circuit conduction between the two circuit boards is realized. Therefore, compared with the traditional welding and adhesion, the flexible connector provided by the embodiments of the disclosure not only can realize repeated disassembly and assembly of the circuit boards, is convenient for maintenance of the circuit boards and reduces the manufacturing cost of electronic products, but also can realize the accurate alignment connection of the two circuit boards and improve the assembly accuracy. On the other hand, compared with the conventional art in which the flexible connector adopts the mode that an elastic arm is connected to a pad, the protrusion portion can increase the contact area between a conductor (i.e. elastic arm) and the pad, so that the contact between the flexible connector and the pad is more sufficient, and the problems of circuit interruption, signal distortion and the like can be avoided. Meanwhile, the protrusion portion can also increase the friction force between the flexible connector and the circuit board, so that in the fastening process of the flexible connector, for example, when a bolt is screwed down, the protrusion portion and the pad are not prone to displacement, and the reliability of electrical connection between the flexible connector and the pad is ensured. In addition, due to the fact that the size of the protrusion portions is relatively small and the arrangement is very tight, the protrusion portions are not easy to break off and the deformation amplitude is uniform, so that the problem of poor contact between a part of the connector and the pad does not occur when the flexible connector provided by the embodiments of the disclosure is pressed with the circuit board. Therefore, compared with the connector provided with the elastic arm, the flexible connector provided by the embodiments of the disclosure has a better contact effect and more reliable conductivity.

The disclosure also provides a manufacturing method of the flexible connector, which has the advantages of simple operation, easiness in implementation and the like.

BRIEF DESCRIPTION OF THE DRAWINGS

The accompanying drawings, which constitute a part of this application, are used to provide a further understanding of the disclosure, and the exemplary embodiments of the disclosure and the description thereof are used to explain the disclosure, but do not constitute improper limitations to the disclosure. In the drawings.

DESCRIPTION OF THE REFERENCE SIGNS

10, insulator; 11, first conductor; 12, second conductor; 13, conductive medium; 14, protrusion portion; 15, conductive hole; 16, adhesive film layer.

DETAILED DESCRIPTION OF THE EMBODIMENTS

It is to be noted that embodiments in the present application and characteristics in the embodiments can be combined under the condition of no conflicts.

The technical solutions in the embodiments of the disclosure will be clearly and completely described hereinbelow with the drawings in the embodiments of the disclosure. It is apparent that the described embodiments are only part of the embodiments of the disclosure, not all of the embodiments. On the basis of the embodiments of the disclosure, all other embodiments obtained on the premise of no creative work of those of ordinary skill in the art fall within the scope of protection of the disclosure.

Embodiment 1

Figure 1:
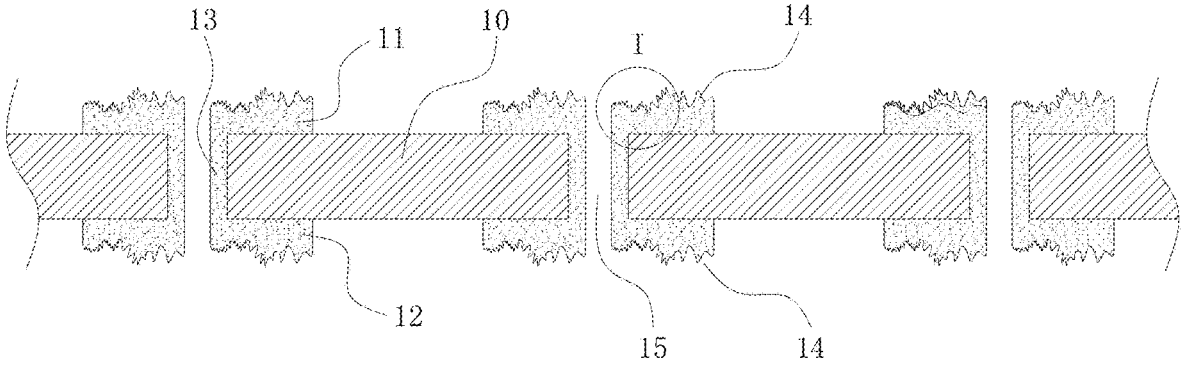
FIG. 1 is a schematic cross-sectional structure view of a flexible connector according to Embodiment 1 of the disclosure.

As shown in FIG. 1, the embodiment of the disclosure provides a flexible connector, which mainly includes an insulator 10. Multiple first conductors 11 are disposed on one side surface of the insulator 10, and multiple second conductors 12 are disposed on the other side surface of the insulator 10. The insulator 10 is further provided with a conductive medium 13 connecting the first conductors 11 and the second conductors 12, and protrusion portions 14 are disposed on the surfaces of the first conductors 11 and the second conductors 12. The insulator 10 is a flexible insulator, the first conductors 11 and the second conductors 12 are disposed on two opposite side surfaces of the insulator 10, and the protrusion portions 14 are plated protrusion portions.

Based on the above structure, on one hand, by clamping the flexible connector provided by the embodiments of the disclosure between two circuit boards, and performing the first conductors 11 and the second conductors 12 adhere to pads on the two circuit boards respectively, the circuit conduction between the two circuit boards is realized. Therefore, compared with the traditional welding and adhesion, the flexible connector provided by the embodiments of the disclosure not only can realize repeated disassembly and assembly of the circuit boards, is convenient for maintenance of the circuit boards and reduces the manufacturing cost of electronic products, but also can realize the accurate alignment connection of the two circuit boards and improve the assembly accuracy. On the other hand, compared with the conventional art in which the flexible connector adopts the mode that an elastic arm is connected to a pad, the protrusion portions 14 can increase the contact area between the first conductors 11 and the second conductors 12 and the pad, so that the contact between the first conductors 11 and the second conductors 12 and the pad is more sufficient, and the problems of circuit interruption, signal distortion and the like can be avoided. Meanwhile, the protrusion portions 14 can also increase the friction force between the first conductors 11 and the second conductors 12 and the circuit board, so that in the fastening process of the flexible connector, for example, when a bolt is screwed down, the first conductors 11 and the second conductors 12 and the pad are not prone to displacement, and the reliability of electrical connection between the first conductors 11 and the second conductors 12 and the pad is ensured. In addition, due to the fact that the size of the protrusion portions 14 is relatively small and the arrangement is very tight, the protrusion portions 14 are not easy to break off and the deformation amplitude is uniform, so that the problem of poor contact between a part of the conductors and the pad does not occur when the flexible connector provided by the embodiments of the disclosure is pressed with the circuit board. Therefore, compared with the connector provided with the elastic arm, the flexible connector provided by the embodiments of the disclosure has a better contact effect and more reliable conductivity.

Specifically, as shown in FIG. 1 to FIG. 9, the protrusion portions 14 have a regular solid geometry or irregular solid geometry, for example, a pointed corner shape, an inverted cone shape, a granular shape, a dendritic shape, a columnar shape, a block shape, etc. Moreover, regardless of the shape, the protrusion portions 14 have a height of 1 μm to 30 μm, where 2.5 μm to 15 μm is the most preferable range. Based on this, the surfaces of the first conductors 11 and the second conductors 12 are provided with two or more protrusion portions 14. The protrusion portions 14 can have the same or different shapes, and the protrusion portions 14 can also have the same or different sizes. That is to say, the shape of the two or more protrusion portions 14 can be one or more of a pointed corner shape, an inverted cone shape, a granular shape, a dendritic shape, a columnar shape, and a block shape. Moreover, the two or more protrusion portions 14 of the same shape can have different sizes including the above height and the length of the protrusion portions 14 in a direction parallel to the side surface of the insulator 10. In addition, the two or more protrusion portions 14 are continuously or discontinuously distributed on the surfaces of the first conductors 11 and the second conductors 12. For example, when the shapes of the two or more protrusions 14 are pointed and continuously distributed, a regular and periodic tooth-like three-dimensional pattern can be formed, or an irregular and disordered tooth-like three-dimensional pattern can be formed. Of course, only one of these cases is enumerated herein, and combinations of other shapes described above are within the scope of the present application and are not specifically enumerated herein.

Figure 2:
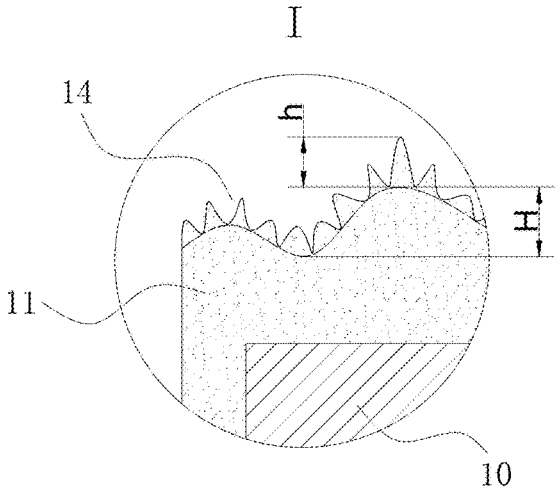
FIG. 2 is an enlarged view of region I of FIG. 1.
Figure 3:
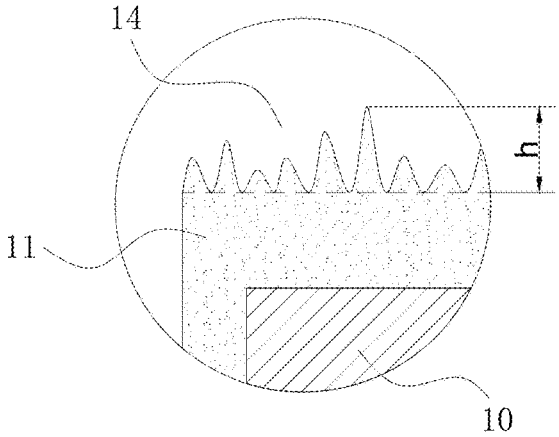
FIG. 3 is a partial view of a first conductor having a flat surface according to Embodiment 1 of the disclosure.
Figure 4:
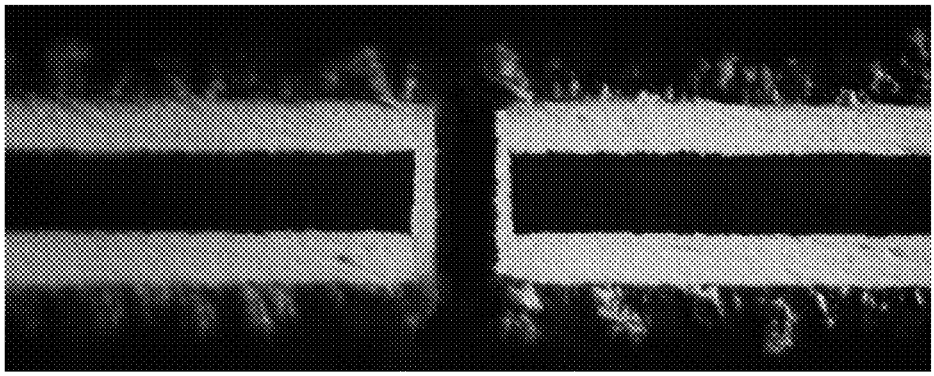
FIG. 4 is a sectional view (1) of a portion of a flexible connector at a magnification of 400× under a metallurgical microscope according to Embodiment 1 of the disclosure.
Figure 5:
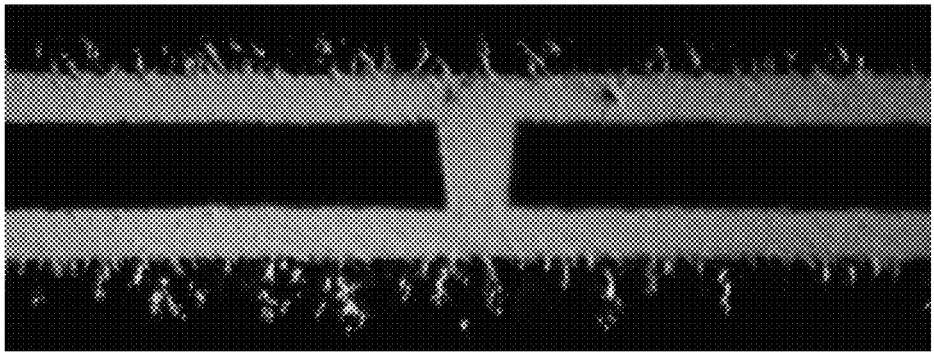
FIG. 5 is a sectional view (2) of a portion of a flexible connector at a magnification of 400× under a metallurgical microscope according to Embodiment 1 of the disclosure.
Figure 6:
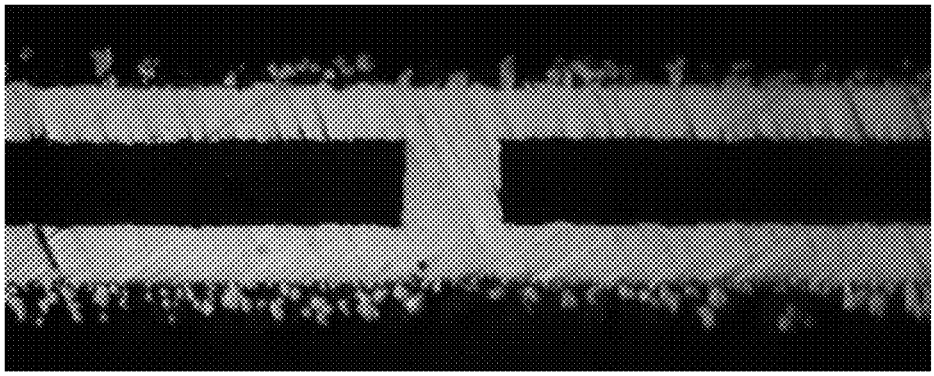
FIG. 6 is a sectional view (3) of a portion of a flexible connector at a magnification of 400× under a metallurgical microscope according to Embodiment 1 of the disclosure.
Figure 7:
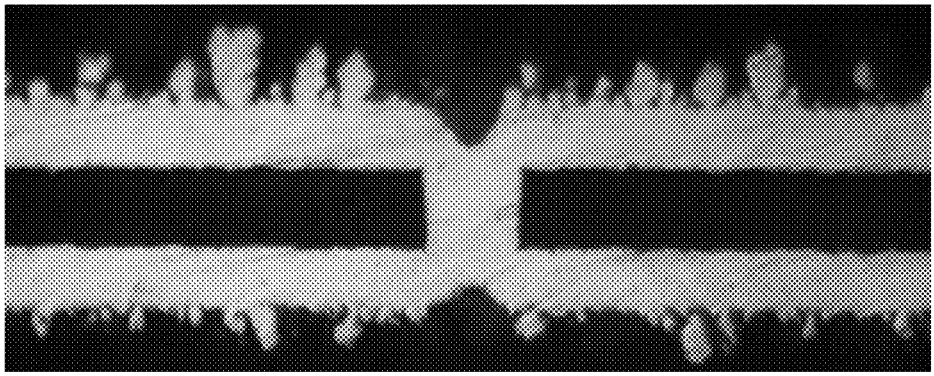
FIG. 7 is a sectional view (4) of a portion of a flexible connector at a magnification of 400× under a metallurgical microscope according to Embodiment 1 of the disclosure.
Figure 8:
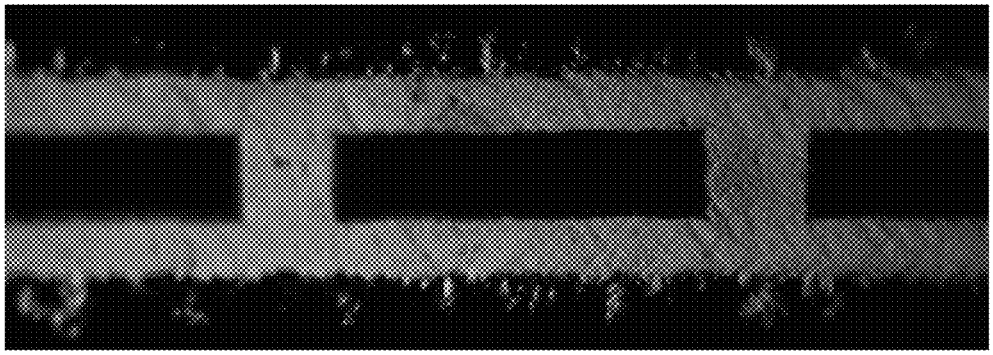
FIG. 8 is a sectional view (5) of a portion of a flexible connector at a magnification of 400× under a metallurgical microscope according to Embodiment 1 of the disclosure.
Figure 9:
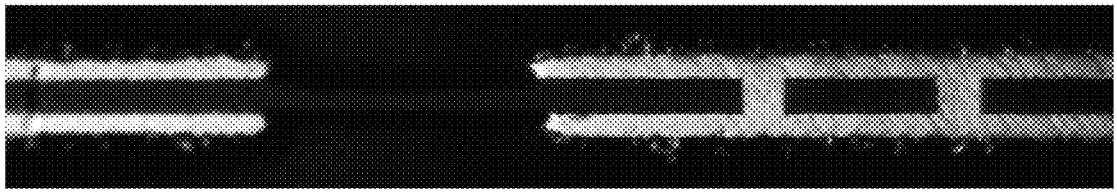
FIG. 9 is a sectional view (6) of a portion of a flexible connector at a magnification of 100× under a metallurgical microscope according to Embodiment 1 of the disclosure.

Optionally, as shown in FIG. 2 and FIG. 3, the surfaces of the first conductors 11 and the second conductors 12 can be flat surfaces or rough surfaces. It is to be noted that the flat and rough surfaces referred to herein are the surfaces of the first conductors 11 and the second conductors 12 on which the protrusion portions 14 are located, that is, reference surfaces on which the protrusion portions 14 are located, rather than a plane formed by the two or more protrusion portions 14. When the surfaces of the first conductors 11 and the second conductors 12 are rough surfaces, the surfaces include concave portions and convex portions, the protrusion portions 14 can be distributed either in the concave portions or in the convex portions, and the sum of the height H of any convex portion and the height h of the protrusion portion 14 on the convex portion can also be 1 μm to 30 μm. Of course, it is also possible that the height h of the protrusion portion 14 on the convex portion is 1 μm to 30 μm, and then the sum of the height H of the convex portion and the height h of the protrusion portion 14 on the convex portion is greater than 1 μm to 30 μm, thereby further enhancing the electrical connection performance of the flexible connector.

Optionally, the protrusion portion 14 is made of one or a combination of a group consist of copper, nickel, lead, chromium, molybdenum, zinc, tin, gold, and silver. Specifically, the protrusion portion 14 can be a single component, i.e., one of copper, nickel, tin, lead, chromium, molybdenum, zinc, gold, and silver. One or more of copper, nickel, tin, lead, chromium, molybdenum, zinc, gold, and silver can also serve as a main body, and then one or more metals other than the main body are formed on the surface of the main body by one or more of electroplating, chemical plating, physical vapor deposition, and chemical vapor deposition, thereby forming the protrusion portion 14 of a composite material. In the present embodiment, the protrusion portion 14 is preferably made of a composite material obtained by forming one or more metals of nickel, tin, lead, chromium, molybdenum, zinc, gold, and silver on the surface of copper which serves as a main body, because the protrusion portion 14 made of copper alone is easily oxidized or abraded and nickel, tin, gold and silver formed on the surface of copper can improve the corrosion resistance and wear resistance of the protrusion portion 14, thereby improving the conductive performance of the connector and prolonging the service life of the connector.

Figure 10:
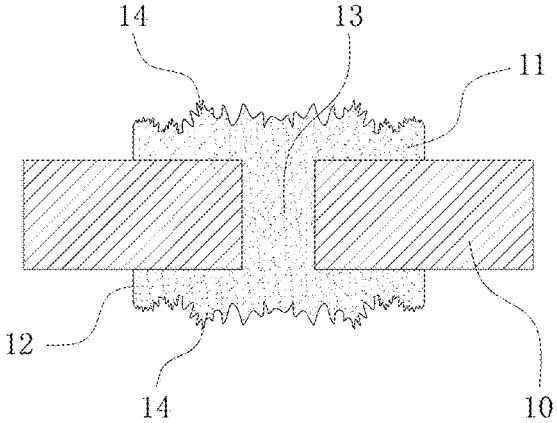
FIG. 10 is a schematic cross-sectional structure view of a connection hole filled with a conductive medium according to Embodiment 1 of the disclosure.

As shown in FIG. 1, the insulator 10 is provided with a connection hole connecting the first conductor 11 and the second conductor 12, the conductive medium 13 is attached to a hole wall of the connection hole and forms a conductive hole 15, and the conductive hole 15 can be a through hole or a buried hole or a blind hole. Of course, as shown in FIG. 10, during the formation of the conductive medium 13, an operator can also choose to fill the entire connection hole with the conductive medium 13, i.e. the conductive hole 15 is not formed. The purpose is to prevent an etching solution from entering the conductive hole 15 and to protect the conductive medium 13 from being etched.

Figure 11:
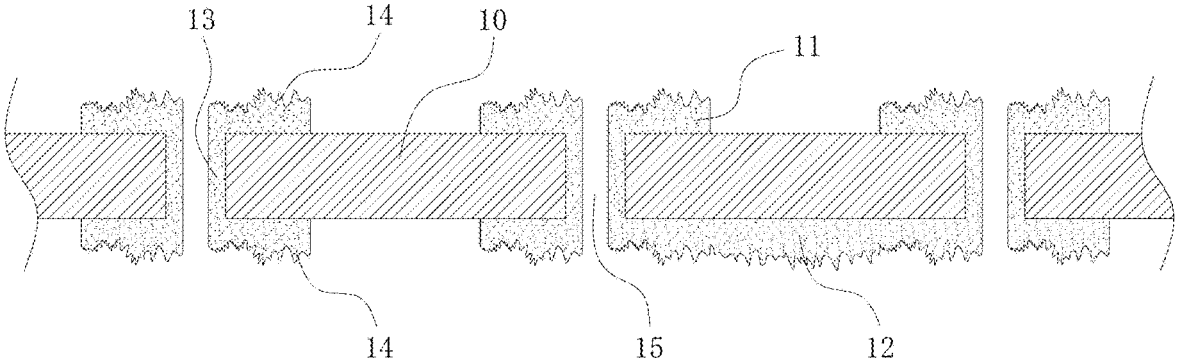
FIG. 11 is a schematic cross-sectional structure view of a second electrical connection form adopted between a first conductor and a second conductor according to Embodiment 1 of the disclosure.
Figure 12:
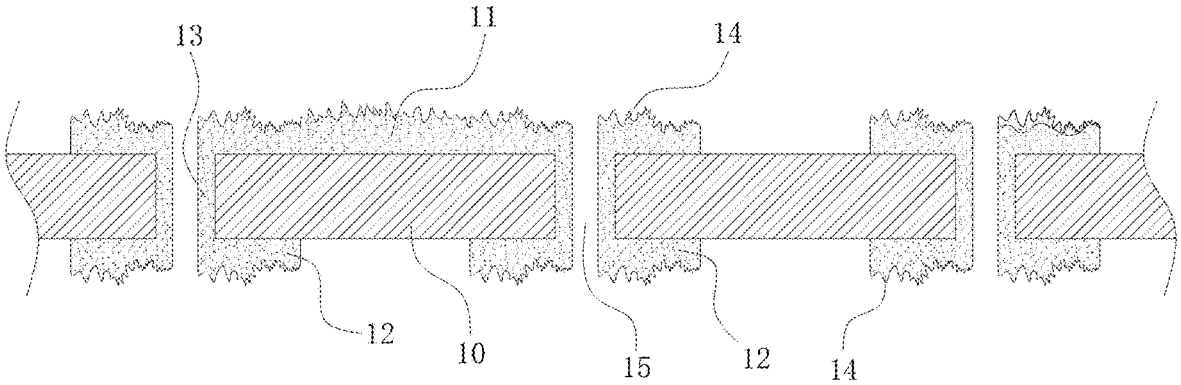
FIG. 12 is a schematic cross-sectional structure view of a third electrical connection form adopted between a first conductor and a second conductor according to Embodiment 1 of the disclosure.
Figure 13:
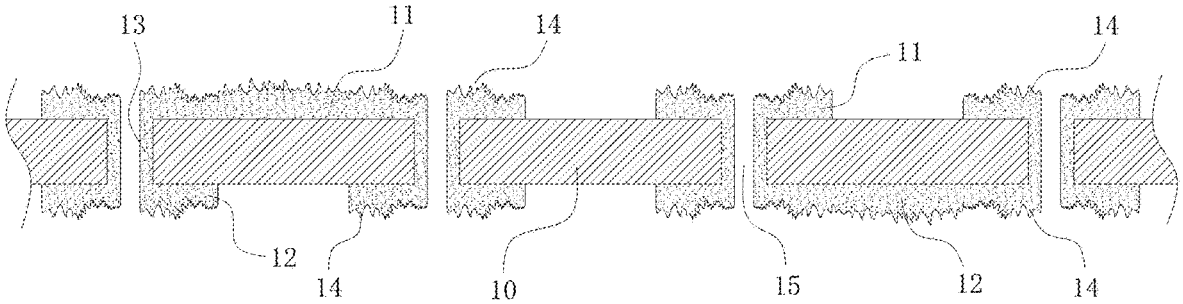
FIG. 13 is a schematic cross-sectional structure view of a fourth electrical connection form adopted between a first conductor and a second conductor according to Embodiment 1 of the disclosure.
Figure 14:
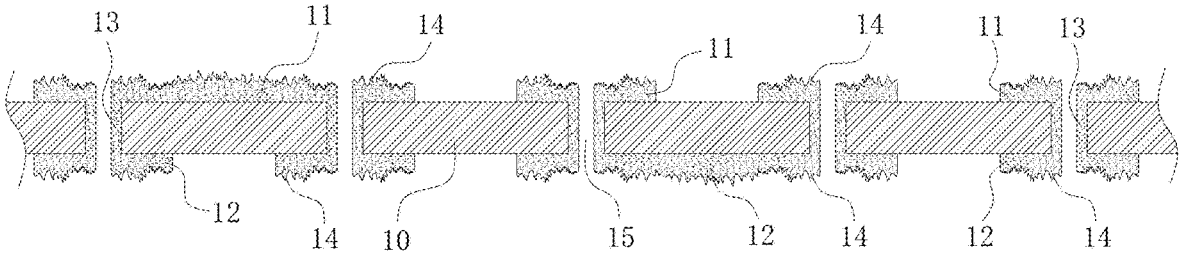
FIG. 14 is a schematic cross-sectional structure view of a fifth electrical connection form adopted between a first conductor and a second conductor according to Embodiment 1 of the disclosure.

In the embodiment of the disclosure, there are two or more first conductors 11 independent of each other, and also, there are two or more second conductors 12 independent of each other. Moreover, the following various connection forms exist between the first conductors 11 and the second conductors 12:

first: as shown in FIG. 1, the number of the second conductors 12 is equal to the number of the first conductors 11, and the first conductors 11 are respectively connected to the second conductors 12 in a one-to-one correspondence manner through the conductive medium 13 in different connection holes;

second: as shown in FIG. 11, the number of the first conductors 11 is more than the number of the second conductors 12, at least two of the first conductors 11 are respectively connected to the same second conductor 12 through the conductive medium 13 in different connection holes, and the other first conductors 11 are respectively connected to the other second conductors 12 in a one-to-one correspondence manner through the conductive medium 13 in different connection holes;

third: as shown in FIG. 12, the number of the first conductors 11 is less than the number of the second conductors 12, at least two of the second conductors 12 are respectively connected to the same first conductor 11 through the conductive medium 13 in different connection holes, and the other second conductors 12 are respectively connected to the other first conductors 11 in a one-to-one correspondence manner through the conductive medium 13 in different connection holes;

fourth: as shown in FIG. 13, at least two of the first conductors 11 are respectively connected to the same second conductor 12 through the conductive medium 13 in different connection holes, and at least two of the second conductors 12 are respectively connected to the same first conductor 11 through the conductive medium 13 in different connection holes;

fifth: as shown in FIG. 14, at least two first conductors 11 in a part of the first conductors are respectively connected to the same second conductor 12 in a part of the second conductors through the conductive medium 13 in different connection holes, at least two second conductors 12 in another part of the second conductors are respectively connected to the same first conductor 11 in another part of the first conductors through the conductive medium in different connection holes, and the other first conductors 11 are respectively connected to the other second conductors 12 in a one-to-one correspondence manner through the conductive medium 13 in different connection holes.

Optionally, regardless of the electrical connection between the first conductor 11 and the second conductor 12, two or more connection holes can be provided between the first conductor 11 and the second conductor 12 connected therewith, and a conductive medium 13 is disposed in each connection hole to further improve the conductivity of the flexible connector.

Optionally, the insulator 10 is made of one or a combination of a group consist of polyimide, thermoplastic polyimide, modified epoxy resin, modified acrylic resin, polyethylene terephthalate, polybutylene terephthalate, polyethylene, polyethylene naphthalate, polystyrene, polyvinyl chloride, polysulfone, polyphenylene sulfide, polyetheretherketone, polyphenylene oxide, polytetrafluoroethylene, liquid crystal polymers, and polyparabanic acid. Specifically, the insulator 10 can be a single component, i.e., one of the various insulating materials described above, or can be formed by compounding any of the various insulating materials described above. Based on this, the insulator 10 has a certain amount of deformation, and when the flexible connector is clamped between two circuit boards, the protrusion portions 14 which are first in contact with the pads are compressed backward, so that the relatively lower protrusion portions 14 can also be in contact with the pads, thereby ensuring reliable electrical connection between the first conductors 11 and the second conductors 12 and the pads.

It is to be noted that, in the embodiment of the disclosure, the protrusion portions 14 are disposed only on the surfaces of the first conductors 11 or the second conductors 12 according to different actual application situations, and the technical effect produced by this solution is consistent with the foregoing and will not be described in detail herein. In addition, the conductive medium 13 in the embodiment of the disclosure is preferably copper, but other materials having good conductive performance such as tin, silver, gold, graphite, copper paste, silver paste, solder paste, and carbon nanotubes can be selected.

Embodiment 2

Figure 15:
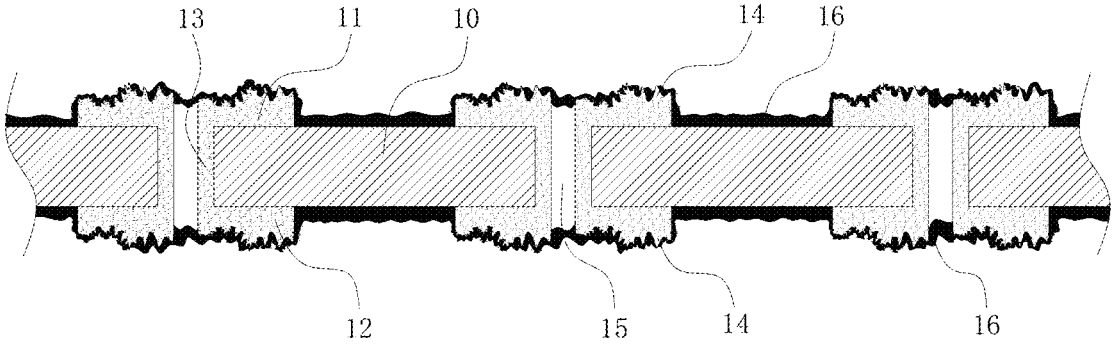
FIG. 15 is a schematic cross-sectional structure view of a flexible connector according to Embodiment 2 of the disclosure.

As shown in FIG. 15, the flexible connector provided by the embodiment of the disclosure differs from the flexible connector provided by Embodiment 1 in that the protrusion portion 14 is provided with an adhesive film layer 16, each protrusion portion 14 is hidden in the adhesive film layer 16 or penetrates through the adhesive film layer 16 and is exposed, and when the protrusion portion 14 is hidden in the adhesive film layer 16, the thickness of the adhesive film layer 16 is smaller than an average value of the height of the protrusion portion 14. Based on this, when the flexible connector is press-adhered to the circuit board, the connection between the flexible connector and the circuit board is more stable due to the adhesion capability of the adhesive film layer 16, and the connector and the circuit board are not easy to loosen and disengage; and during the press-adhesion process, since the adhesive film layer 16 has fluidity, all or part of the protrusion portions 14 which have not penetrated through the adhesive film layer 16 penetrate through the adhesive film layer 16 and are in contact with the pad on the circuit board together with the protrusion portions 14 which have penetrated through the adhesive film layer 16 before, so that a reliable electrical connection is formed between the first conductors 11 or/and the second conductors 12 and the pad, and it is ensured that the flexible connector still has good conductive performance during adhesion. Of course, in order to simplify the process, the adhesive film layer 16 in the embodiment of the disclosure is formed directly on the entire surface of the flexible connector, and therefore, the adhesive film layer 16 is formed on the surface of the insulator 10 where the first conductors 11 or/and the second conductors 12 provided with the protrusion portions 14 are located, in addition to the protrusion portions 14.

Preferably, in the embodiment of the disclosure, the adhesive film layer 16 is preferably a pressure sensitive adhesive or a thermoplastic adhesive, but the adhesive film layer 16 can be a thermosetting adhesive or the like according to different actual application situations. In addition to the above differences, other specific structures of the embodiment of the disclosure are consistent with those in Embodiment 1, corresponding principles and technical effects are also consistent, and further description thereof will be omitted herein.

Embodiment 3

The embodiment of the disclosure provides a manufacturing method of a flexible connector, which includes the following steps;

In step 1, a flexible copper-clad plate was manufactured, the flexible copper-clad plate including an insulator and copper foils disposed on two opposite surfaces of the insulator;

In step 2, a connection hole connecting the copper foils on two sides was formed in the flexible copper-clad plate by means of mechanical drilling, laser drilling or punching;

In step 3, a conductive medium 13 was formed in the connection hole to make the connection hole conductive, while forming a protrusion portion 14 on the surface of the copper foil on at least one side of the flexible copper-clad plate;

In step 4, two side surfaces of the flexible copper-clad plate were etched respectively to form a first conductor 11 and a second conductor 12;

In step 5, an adhesive film layer 16 was formed on at least one side surface of the flexible copper-clad plate.

In step 3 provided by the embodiment of the disclosure, the operation that the conductive medium 13 was formed in the connection hole while forming the protrusion portion 14 on the surface of the copper foil on at least one side of the flexible copper-clad plate specifically included that:

a layer of thin conductive medium 13 was deposited on a hole wall of the connection hole through a chemical reaction, the thickness of the conductive medium 13 on the hole wall was increased and a conductive hole 15 was formed by one or more of electroplating, chemical plating, physical vapor deposition, and chemical vapor deposition, while forming the protrusion portion 14 on the surface of the copper foil on at least one side of the flexible copper-clad plate;

or a layer of thin conductive medium 13 was deposited on a hole wall of the connection hole through a chemical reaction, the connection hole was filled with the conductive medium 13 by one or more of electroplating, chemical plating, physical vapor deposition, and chemical vapor deposition, while forming the protrusion portion 14 on the surface of the copper foil on at least one side of the flexible copper-clad plate.

The above-mentioned "thin conductive medium" is with respect to the subsequent continued placement of the conductive medium, the process of forming the conductive medium 13 is the process of metallizing holes in the conventional art, and the thickness of the previously formed thin conductive medium 13 can be referred to the conventional art and will not be described in detail herein.

And in step 3, when the protrusion portion 14 was formed on the surface of the copper foil on at least one side of the flexible copper-clad plate by one or more of electroplating, chemical plating, physical vapor deposition, chemical vapor deposition, etc., the height of the formed protrusion portion 14 could be controlled by controlling the magnitude of the current density when electroplating is adopted. Generally, when other conditions are the same, as the current density is larger, the roughness is larger, i.e. the height of the protrusion portion is larger; as the current density is smaller, the roughness is smaller, i.e. the height of the protrusion portion is smaller. By the same reasoning, it can be concluded that when the conductive medium is disposed in the connection hole, the current density can be relatively small, so that a denser conductive medium 13 is formed, and the conductive reliability is improved. When other ways are adopted, the height of the protrusion portion can also be adjusted by control of the operating conditions.

In step 5 provided by the embodiment of the disclosure, the operation that the adhesive film layer 16 was formed on at least one side surface of the flexible copper-clad plate specifically included that:

the adhesive film layer 16 was coated on a release film, and then the adhesive film layer 16 was laminated and transferred to at least one side surface of the flexible copper-clad plate through the release film;

or the adhesive film layer 16 was directly coated on at least one side surface of the flexible copper-clad plate.

Embodiment 4

The embodiment of the disclosure provides a manufacturing method of a flexible connector, which includes the following steps.

In step 1, a flexible copper-clad plate was manufactured, the flexible copper-clad plate including an insulator and copper foils disposed on two opposite surfaces of the insulator;

In step 2, a connection hole connecting the copper foils on two sides was formed in the flexible copper-clad plate by means of mechanical drilling, laser drilling or punching;

In step 3, a conductive medium 13 was formed in the connection hole to make the connection hole conductive;

In step 4, copper foils were etched on two sides of the flexible copper-clad plate respectively to form multiple first conductors 11 and multiple second conductors 12, the specific method is consistent with that described in step 4 in Embodiment 3 and will not be described in detail herein;

In step 5, the protrusion portions 14 were formed on the surfaces of the first conductors 11 or/and the second conductors 12 by one or more of electroplating, chemical plating, physical vapor deposition, and chemical vapor deposition.

In step 6, an adhesive film layer 16 was formed on at least one side surface of the flexible copper-clad plate, the specific method is consistent with that described in step 5 in Embodiment 3 and will not be described in detail herein.

In step 3 provided by the embodiment of the disclosure, the operation that the conductive medium 13 was formed in the connection hole specifically included that:

a layer of thin conductive medium 13 was deposited on a hole wall of the connection hole through a chemical reaction, the thickness of the conductive medium 13 on the hole wall was increased and a conductive hole 15 was formed by one or more of electroplating, chemical plating, physical vapor deposition, and chemical vapor deposition;

or a layer of thin conductive medium 13 was deposited on a hole wall of the connection hole through a chemical reaction, the connection hole was filled with the conductive medium 13 by one or more of electroplating, chemical plating, physical vapor deposition, and chemical vapor deposition.

The above-mentioned "thin conductive medium" is with respect to the subsequent continued placement of the conductive medium, the process of forming the conductive medium 13 is the process of metallizing holes in the conventional art, and the thickness of the previously formed thin conductive medium 13 can be referred to the conventional art and will not be described in detail herein.

Embodiment 5

The embodiment of the disclosure provides a manufacturing method of a flexible connector, which includes the following steps.

In step 1, a flexible copper-clad plate was manufactured, the flexible copper-clad plate including an insulator and copper foils disposed on two opposite surfaces of the insulator;

In step 2, a protrusion portion 14 was formed on the surface of the copper foil on at least one side of the flexible copper-clad plate by one or more of electroplating, chemical plating, physical vapor deposition, and chemical vapor deposition;

In step 3, a connection hole connecting the copper foils on two sides was formed in the flexible copper-clad plate by means of mechanical drilling, laser drilling or punching;

In step 4, a conductive medium 13 was formed in the connection hole to make the connection hole conductive;

In step 5, two side surfaces of the flexible copper-clad plate were etched respectively to form a first conductor 11 and a second conductor 12, the specific method is consistent with that described in step 4 in Embodiment 3 and will not be described in detail herein;

In step 6, an adhesive film layer 16 was formed on at least one side surface of the flexible copper-clad plate, the specific method is consistent with that described in step 5 in Embodiment 3 and will not be described in detail herein.

In step 4 provided by the embodiment of the disclosure, the operation that the conductive medium 13 was formed in the connection hole specifically included that:

a layer of thin conductive medium 13 was deposited on a hole wall of the connection hole through a chemical reaction, the thickness of the conductive medium 13 on the hole wall was increased and a conductive hole 15 was formed by one or more of electroplating, chemical plating, physical vapor deposition, and chemical vapor deposition;

or a layer of thin conductive medium 13 was deposited on a hole wall of the connection hole through a chemical reaction, the connection hole was filled with the conductive medium 13 by one or more of electroplating, chemical plating, physical vapor deposition, and chemical vapor deposition.

The above-mentioned "thin conductive medium" is with respect to the subsequent continued placement of the conductive medium, the process of forming the conductive medium 13 is the process of metallizing holes in the conventional art, and the thickness of the previously formed thin conductive medium 13 can be referred to the conventional art and will not be described in detail herein.

In summary, the disclosure provides a flexible connector, which includes an insulator 10. Multiple first conductors 11 are disposed on one side surface of the insulator 10, and multiple second conductors 12 are disposed on the other side surface of the insulator 10. The insulator 10 is further provided with a conductive medium 13 connecting the first conductors 11 and the second conductors 12, and protrusion portions 14 are disposed on the surfaces of the first conductors 11 and the second conductors 12. Compared with the conventional art, the flexible connector is good in conductivity, long in service life, high in reliability, low in manufacturing cost, and capable of being repeatedly disassembled and assembled.

In addition, the disclosure also provides a manufacturing method of the flexible connector, which has the advantages of simple operation, easiness in implementation and the like.

The above-mentioned "thin conductive medium" is with respect to the subsequent continued placement of the conductive medium, the process of forming the conductive medium 13 is the process of metallizing holes in the conventional art, and the thickness of the previously formed thin conductive medium 13 can be referred to the conventional art and will not be described in detail herein.

It should be understood that the terms "first", "second", and the like are used herein to describe various types of information, but such information should not be limited to these terms, and these terms are used solely to distinguish one type of information from another. For example, "first" information can also be referred to as "second" information, and similarly, "second" information can also be referred to as "first" information, without departing from the scope of the disclosure.

The above is a preferred implementation of the disclosure. It is to be noted that a number of modifications and variations can be made by those of ordinary skill in the art without departing from the principles of the disclosure, and such modifications and variations are also considered to be within the scope of protection of the disclosure.

What is claimed is:

1. A flexible connector, comprising an insulator, a plurality of first conductors being disposed on one side surface of the insulator, a plurality of second conductors being disposed on the other side surface of the insulator, the insulator being further provided with a conductive medium connecting the first conductors and the second conductors, and a protrusion portion being disposed on the surfaces of the first conductors or/and the second conductors;

wherein an adhesive film layer is disposed on at least one side surface of the insulator or/and the protrusion portion;

wherein the protrusion portion is hidden in the adhesive film layer, a thickness of the adhesive film layer being smaller than an average value of the height of the protrusion portion; or the protrusion portion penetrates through the adhesive film layer and is exposed.

2. The flexible connector according to claim 1, wherein the protrusion portion has a regular solid geometry or irregular solid geometry.

3. The flexible connector according to claim 2, wherein the protrusion portion has a pointed corner shape, an inverted cone shape, a granular shape, a dendritic shape, a columnar shape, or a block shape.

4. The flexible connector according to claim 1, wherein the protrusion portion has a height of 1 μm to 30 μm.

5. The flexible connector according to claim 1, wherein the surfaces of the first conductor or/and the second conductor are provided with two or more of the protrusion portions, each one of the protrusion portions having the same or different shapes, each one of the protrusion portions having the same or different sizes, as well as two or more of the protrusion portions being continuously or discontinuously distributed on the surfaces of the first conductor or/and the second conductor.

6. The flexible connector according to claim 1, wherein the surfaces of the first conductor or/and the second conductor are rough or flat.

7. The flexible connector according to claim 1, wherein the protrusion portion is made of one or a combination of a group consist of copper, nickel, tin, lead, chromium, molybdenum, zinc, gold, and silver.

8. The flexible connector according to claim 1, wherein the insulator is provided with a connection hole connecting the first conductor and the second conductor, and the conductive medium is disposed in the connection hole.

9. The flexible connector according to claim 8, wherein the conductive medium fills the whole of the connection hole, or the conductive medium is attached to a hole wall of the connection hole and forms a conductive hole.

10. The flexible connector according to claim 8, wherein the number of the first conductors is two or more, the first conductors are independent of each other, the number of the second conductors is two or more, the second conductors are independent of each other, the number of the second conductors is equal to the number of the first conductors, and the first conductors are respectively connected to the second conductors in a one-to-one correspondence manner through the conductive medium in the different connection holes.

11. The flexible connector according to claim 8, wherein the number of the first conductors is two or more, the first conductors are independent of each other, the number of the second conductors is two or more, the second conductors are independent of each other, the number of the first conductors is more than the number of the second conductors, at least two of the first conductors are respectively connected to the same second conductor through the conductive medium in the different connection holes, and the other first conductors are respectively connected to the other second conductors in a one-to-one correspondence manner through the conductive medium in the different connection holes.

12. The flexible connector according to claim 8, wherein the number of the first conductors is two or more, the first conductors are independent of each other, the number of the second conductors is two or more, the second conductors are independent of each other, at least two of the first conductors are respectively connected to the same second conductor through the conductive medium in the different connection holes, and at least two of the second conductors are respectively connected to the same first conductor through the conductive medium in the different connection holes.

13. The flexible connector according to claim 8, wherein the number of the first conductors is two or more, the first conductors are independent of each other, the number of the second conductors is two or more, the second conductors are independent of each other, at least two of the first conductors in a part of the first conductors are respectively connected to the same second conductor in a part of the second conductors through the conductive medium in the different connection holes, at least two of the second conductors in another part of the second conductors are respectively connected to the same first conductor in another part of the first conductors through the conductive medium in the different connection holes, and the other first conductors are respectively connected to the other second conductors in a one-to-one correspondence manner through the conductive medium in the different connection holes.

14. The flexible connector according to claim 8, wherein two or more of the connection holes are provided between the first conductor and the second conductor connected therewith.

15. The flexible connector according to claim 1, wherein the insulator is made of one or a combination of a group consist of polyimide, thermoplastic polyimide, modified epoxy resin, modified acrylic resin, polyethylene terephthalate, polybutylene terephthalate, polyethylene, polyethylene naphthalate, polystyrene, polyvinyl chloride, polysulfone, polyphenylene sulfide, polyetheretherketone, polyphenylene oxide, polytetrafluoroethylene, liquid crystal polymers, and polyparabanic acid.

16. The flexible connector according to claim 1 wherein the insulator is a flexible insulator, the first conductors and the second conductors are disposed on two opposite side surfaces of the insulator, and the protrusion portion is a plated protrusion portion.

17. A manufacturing method of a flexible connector, comprising following steps:

manufacturing a flexible copper-clad plate, the flexible copper-clad plate comprising an insulator and copper foils disposed on two opposite surfaces of the insulator;

forming a connection hole on the flexible copper-clad plate;

forming a conductive medium in the connection hole to make the connection hole conductive, while forming a protrusion portion on the surface of the copper foil on at least one side of the flexible copper-clad plate; and respectively etching two sides of the flexible copper-clad plate to form a first conductor and a second conductor.

18. The manufacturing method according to claim 17, wherein the connection hole connecting the copper foils on two sides is formed in the flexible copper-clad plate by means of mechanical drilling, laser drilling or punching.

19. The manufacturing method according to claim 17, wherein forming the conductive medium in the connection hole while forming the protrusion portion on the surface of the copper foil on at least one side of the flexible copper-clad plate specifically comprises:

depositing a layer of thin conductive medium on a hole wall of the connection hole through a chemical reaction, increasing a thickness of the conductive medium on the hole wall and forming a conductive hole by one or more of electroplating, chemical plating, physical vapor deposition, and chemical vapor deposition, while forming the protrusion portion on the surface of the copper foil on at least one side of the flexible copper-clad plate;

or depositing a layer of thin conductive medium on a hole wall of the connection hole through a chemical reaction, filling the connection hole with the conductive medium by one or more of electroplating, chemical plating, physical vapor deposition, and chemical vapor deposition, while forming the protrusion portion on the surface of the copper foil on at least one side of the flexible copper-clad plate.

20. The manufacturing method according to claim 17, wherein after respectively etching two sides of the flexible copper-clad plate to form the first conductor and the second conductor, the method further comprises: forming an adhesive film layer on at least one side surface of the flexible copper-clad plate, specifically comprising:

coating the adhesive film layer on a release film, and then laminating and transferring the adhesive film layer to at least one side surface of the flexible copper-clad plate through the release film;

or directly coating the adhesive film layer on at least one side surface of the flexible copper-clad plate.

21. A manufacturing method of a flexible connector, comprising following steps:

manufacturing a flexible copper-clad plate, the flexible copper-clad plate comprising an insulator and copper foils disposed on two opposite surfaces of the insulator;

forming a connection hole on the flexible copper-clad plate;

forming a conductive medium in the connection hole to make the connection hole conductive;

respectively etching the copper foils on two sides of the flexible copper-clad plate to form a plurality of first conductors and a plurality of second conductors; and forming protrusion portions on the surfaces of the first conductors or/and the second conductors.

22. The manufacturing method according to claim 21, wherein the connection hole connecting the copper foils on two sides is formed in the flexible copper-clad plate by means of mechanical drilling, laser drilling or punching.

23. The manufacturing method according to claim 21, wherein forming the conductive medium in the connection hole specifically comprises:

depositing a layer of thin conductive medium on a hole wall of the connection hole through a chemical reaction, increasing a thickness of the conductive medium on the hole wall and forming a conductive hole by one or more of electroplating, chemical plating, physical vapor deposition, and chemical vapor deposition;

or depositing a layer of thin conductive medium on a hole wall of the connection hole through a chemical reaction, filling the connection hole with the conductive medium by one or more of electroplating, chemical plating, physical vapor deposition, and chemical vapor deposition.

24. The manufacturing method according to claim 21, wherein the protrusion portions are formed on the surfaces of the first conductors or/and the second conductors by one or more of electroplating, chemical plating, physical vapor deposition, and chemical vapor deposition.

25. The manufacturing method according to claim 21, wherein after forming the protrusion portions on the surfaces of the first conductors or/and the second conductors, the method further comprises: forming an adhesive film layer on at least one side surface of the flexible copper-clad plate, specifically comprising:

coating the adhesive film layer on a release film, and then laminating and transferring the adhesive film layer to at least one side surface of the flexible copper-clad plate through the release film;

or directly coating the adhesive film layer on at least one side surface of the flexible copper-clad plate.

26. A manufacturing method of a flexible connector, comprising following steps:

manufacturing a flexible copper-clad plate, the flexible copper-clad plate comprising an insulator and copper foils disposed on two opposite surfaces of the insulator;

forming a protrusion portion on the surface of the copper foil on at least one side of the flexible copper-clad plate;

forming a connection hole on the flexible copper-clad plate;

forming a conductive medium in the connection hole to make the connection hole conductive; and respectively etching two sides of the flexible copper-clad plate to form a first conductor and a second conductor.

27. The manufacturing method according to claim 26, wherein the protrusion portion is formed on the surface of the copper foil on at least one side of the flexible copper-clad plate by one or more of electroplating, chemical plating, physical vapor deposition, and chemical vapor deposition.

28. The manufacturing method according to claim 26, wherein the connection hole connecting the copper foils on two sides is formed in the flexible copper-clad plate by means of mechanical drilling, laser drilling or punching.

29. The manufacturing method according to claim 26, wherein forming the conductive medium in the connection hole specifically comprises:

depositing a layer of thin conductive medium on a hole wall of the connection hole through a chemical reaction, increasing a thickness of the conductive medium on the hole wall and forming a conductive hole by one or more of electroplating, chemical plating, physical vapor deposition, and chemical vapor deposition;

or depositing a layer of thin conductive medium on a hole wall of the connection hole through a chemical reaction, filling the connection hole with the conductive medium by one or more of electroplating, chemical plating, physical vapor deposition, and chemical vapor deposition.

30. The manufacturing method according to claim 26, wherein after respectively etching two sides of the flexible copper-clad plate to form the first conductor and the second conductor, the method further comprises: forming an adhesive film layer on at least one side surface of the flexible copper-clad plate, specifically comprising:

coating the adhesive film layer on a release film, and then laminating and transferring the adhesive film layer to at least one side surface of the flexible copper-clad plate through the release film;

or directly coating the adhesive film layer on at least one side surface of the flexible copper-clad plate.

* * * * *